United States Patent [19]

Bishop

[11] Patent Number: 4,488,651

[45] Date of Patent: Dec. 18, 1984

[54] CLOTHES RACK

[76] Inventor: Charles W. Bishop, 657 Soudan Ave., Toronto, Ontario, Canada

[21] Appl. No.: 345,347

[22] Filed: Feb. 3, 1982

[30] Foreign Application Priority Data

Feb. 16, 1981 [CA] Canada ..... 370983

[51] Int. Cl.[3] ..... A47F 5/13

[52] U.S. Cl. ..... 211/105.6; 211/86

[58] Field of Search ..... 248/215, 227; 211/105.1, 105.3, 105.5, 105.6, 86, 123; 403/109

[56] References Cited

U.S. PATENT DOCUMENTS

| | | | |
|---|---|---|---|
| 2,519,996 | 8/1950 | Blake | 211/105.6 |
| 2,973,870 | 3/1961 | Schoos | 211/105.6 X |
| 3,019,909 | 2/1962 | Churchill | 211/86 |
| 3,146,890 | 9/1964 | Cowper | 211/86 |
| 3,163,295 | 12/1964 | Standard | 211/86 |
| 3,570,412 | 3/1971 | Holman | 211/105.6 X |

FOREIGN PATENT DOCUMENTS

| | | | |
|---|---|---|---|
| 748729 | 12/1966 | Canada | 211/105.6 |

*Primary Examiner*—J. Franklin Foss
*Assistant Examiner*—Robert W. Gibson, Jr.
*Attorney, Agent, or Firm*—George A. Rolston

[57] ABSTRACT

Support rod for use between a wall and a rail and having an outer tubular rod, an inner rod telescopically receivable within the outer rod, a spring within the outer rod and engagable with the inner rod for normally biasing it outwardly of the outer rod, engaging means on the free ends of the outer and inner rods, for engaging the wall and rail, retaining means on one of the engaging means extending into the free end of the outer rod, and, spring attachment means on the retaining means for attaching the spring within the outer rod.

4 Claims, 3 Drawing Figures

CLOTHES RACK

The invention relates to a rack for hanging clothing, in a room, typically a bathroom.

BACKGROUND OF THE INVENTION

It is desirable, in various locations, to erect a rail or rack from which clothing can be hung. In the majority of cases, such a rail or rack must be attached to the wall, by special fastenings. In many cases, however, such as in closets, bathrooms, hotel rooms and the like, it is clearly impossible to install a permanent fixture. Where the clothing is wet, and must be drip-dried, then it is desirable to hang the clothing directly over the bathtub. Bathtubs are usually installed with a rail for carrying a shower curtain, but when clothing is suspended from such a rail water will drip onto the floor rather than the bathtub.

Accordingly, there have been proposed in the past, devices which can be attached between the shower rail and the enclosure around the bathtub. One such device is shown in Canadian Letters Patent No. 748,729. In that case, a pair of tubular rods are arranged in a telescoping formation, and a spring is located in the larger of the two rods, forcing the small rod outwardly.

One of the rods is provided with a pad for engaging the enclosure around the tub, and the other rod is provided with a hook for engaging the shower rail.

The device worked effectively, but has proved relatively expensive to manufacture.

Accordingly, the object of the invention is to provide a device of the same type, but which incorporates modifications in the structure of the hook and modifications in the fastening of the hook to the spring, and the securing of the hook in the free end of the rod, so as to make the entire structure cheaper to manufacture. At the same time an improved appearance is provided, giving the device a more marketable appealing design.

The various features of novelty which characterize the invention are pointed out with particularity in the claims annexed with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
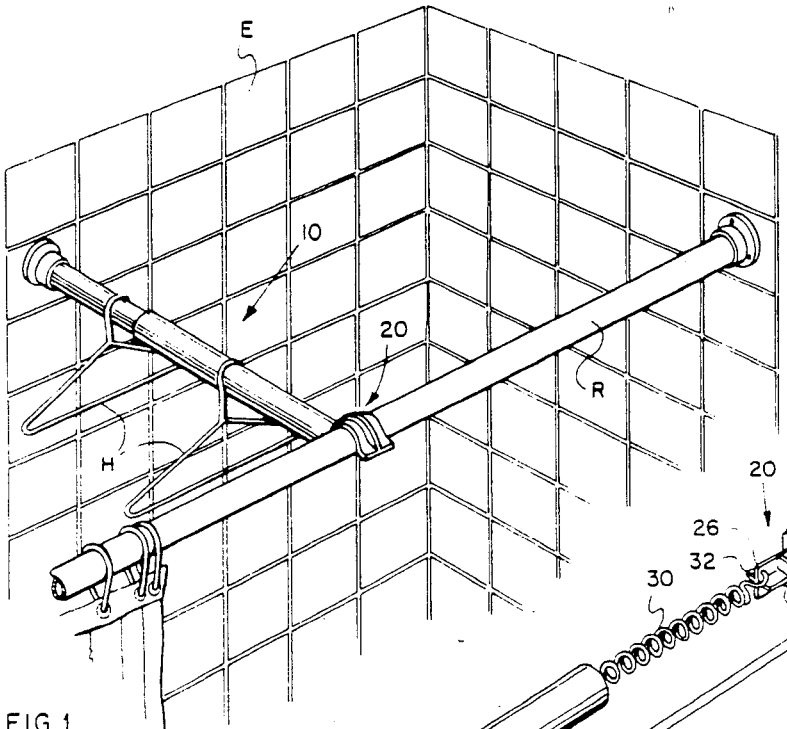
FIG. 1 is an upper perspective illustration showing the corner of a bathtub enclosure, and shower rail therein, with the clothes rack device of the invention shown installed.

As shown in the drawings, the device illustrated generally as 10, is shown in use between a shower curtain rail R and an enclosure E, around a bathtub (not shown). Hangers H are shown supported on the device 10, the hangers H being located perpendicularly above the bathtub in such a manner that wet clothing thereon may drip-dry, and the water will collect and pass down the waste receptacle from the bathtub.

Figure 3:
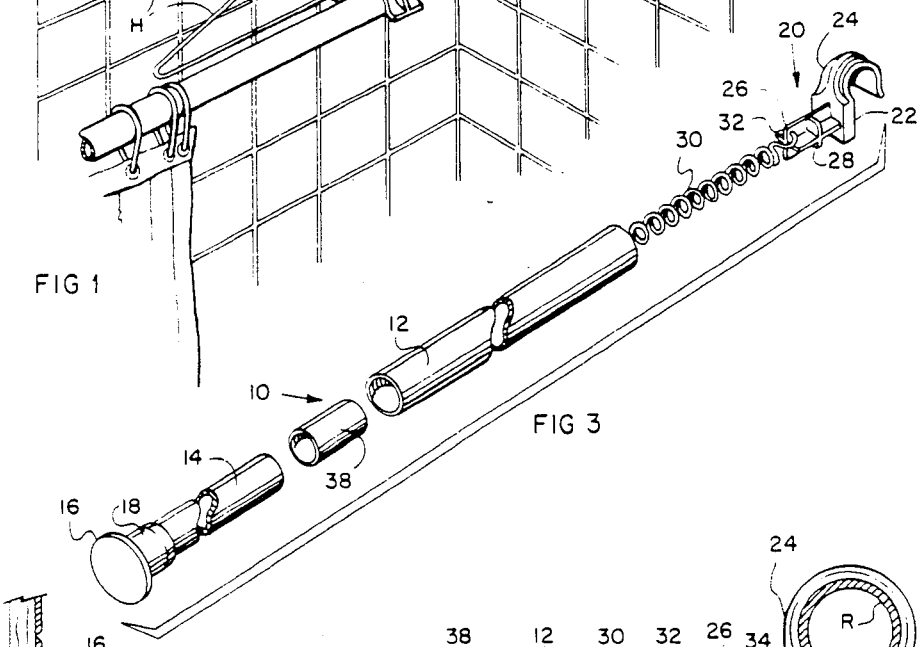
FIG. 3 is an exploded perspective illustration partially cut away of the device of FIGS. 1 and 2.
Figure 2:
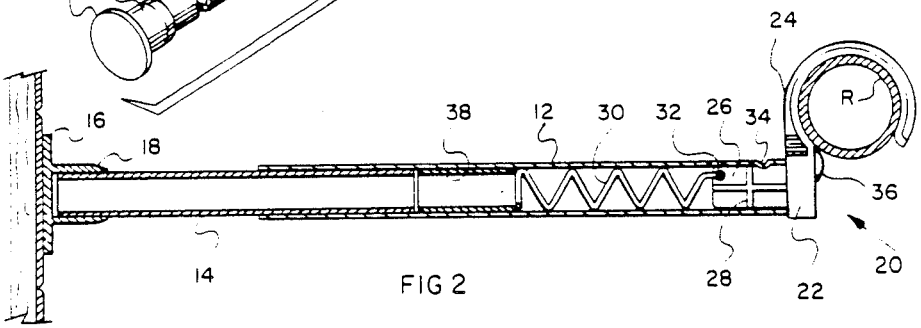
FIG. 2 is a section on the line 2—2 of FIG. 1.

As shown in more detail in FIGS. 2 and 3, the clothes rack 10 will be seen to comprise two tubular rods 12 and 14, the rod 14 being of smaller diameter than the rod 12 so that it may telescope within rod 12.

At the outer free ends of rods 12 and 14 engaging means are provided for engaging the wall, and rail. Thus, at one end of rod 14 there is provided a pad 16 formed with an integral socket 18 fitting around the tube 14 as shown. The pad 16 is formed of molded thermoplastic material, and may have a frictional surface designed not to slip on the tiles of the enclosure E. However, in fact, it is found in practice that in normal use such slippage is no problem.

Tube 12 is provided at one end with an integral molded thermoplastic body indicated as 20. The body 20 comprises a generally rectangular flat end stop 22, having an upwardly projecting semicircular hook portion 24. The hook portion 24 subtends an arc somewhat greater than 180°, and is sufficiently resilient that it may be expanded to snap over the rail R and then hold itself securely in place.

Desirably, the end stop portion 22 is located below one end of the hook portion 24 for reasons to be described below.

Projecting normal to end stop 22, there is provided a generally elongated cruciform structure 26, provided with generally wedge shaped inserts 28. The inserts 28 have a generally semicircular arcuate free edge, and define a generally circular profile adapted to fit snugly within tube 12 (FIG. 2).

The cruciform structure 26 likewise defines a cross-section which is adapted to fit snugly within tube 12 (FIG. 2).

It will of course be appreciated that the rail-engaging hook 24 could be replaced by a wall pad similar to pad 16, and the pad 16 could be replaced by a hook, without altering the inventive principles.

A spring 30 is located within tube 12, and is fastened at one end by means of a hook 32 passing through a suitable hole in the cruciform structure 26. In its undeformed state, spring 30 may not reach from one end of tube 12 to the other.

The other end of the spring 30 is free to travel within the tube 12. It will thus be seen that the tube 14, upon being inserted into the tube 12 as shown in FIG. 2, will engage the spring 30, and further insertion of the tube 14 will thus compress the spring 30.

The cruciform structure 26 is inserted into the open end of tube 12 and makes a snug push fit. In order to retain it in position, one or more indentations 34 are then formed in the tube 12 adjacent to the inserts 28, between the inserts 28 and the end stop 22, so that it cannot thereafter be withdrawn.

In use, the tube 14 is inserted into the open end of tube 12, and will engage the spring 30. In order to attach it in position as shown in FIG. 1, the tube 14 is forced into tube 12 and compresses the spring 30. The hook 24 is then snapped over the rail R, and the end stop 16 can then be released against the enclosure E. The spring 30 will thus press the pad 16 firmly against the enclosure E.

Any tendency for the hook portion 24 to become dislodged, is prevented by button 36.

In the event that the enclosure E is of unusual width dimensions, one or more tube extensions 38 may be introduced into tube 12 so as to extend tube 14 to a greater distance. Of course, tube extensions 36 cannot be so long as to prevent tube 14 from being inserted into tube 12 or the device would fall apart. Extensions 38 will normally be of tubular construction, designed to fit snugly within tube 12, and to engage spring 30 and tube 14. Thus they may be end portions of tube 14 cut off for the purpose. Alternatively, they may be molded thermoplastic structures.

It will be observed that there is nothing securing the tube 14 within the tube 12. Thus the tube 14 can simply be completely removed for shipping and storage. The spring 30 is retained within tube 12 by means of hook 32 engaged in cruciform structure 26 so that it cannot become lost.

Having described what is believed to be the best mode by which the invention may be performed, it will be seen that the invention may be particularly defined as follows:

Support rod apparatus for use in association with two structures such as a wall, and rail means spaced from such wall, for removably locating a support rod extending between said structures, said apparatus comprising outer tubular rod means shorter than the spacing between said structures, inner rod means telescopically receivable within said outer rod means, and being shorter than the spacing between said structures, spring means located within said outer rod means, and engageable with said inner rod means for normally biasing the same outwardly of said outer rod means, structure engaging means on the free ends of said outer and inner rod means, for engaging said structures, retaining means formed integrally with one of said engaging means extending into said free end of said outer rod means for retaining same therein, and spring attachment means on said retaining means whereby said spring means may be attached to said retaining means and secured within said outer rod means for ease of assembly.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Support rod apparatus for use in association with two structures such as a wall, and rail means spaced from such wall, for removably locating a support rod extending between said structures, said apparatus comprising;

outer tubular rod means shorter than the spacing between said structures;

inner rod means telescopically receivable within said outer rod means, and being shorter than the spacing between said structures;

spring means located within said outer rod means, and engageable with said inner rod means for normally biasing the same outwardly of said outer rod means;

wall engaging means on the free end of the said inner rod means, for engaging said wall;

rail engaging means on the free end of the said outer rod means, comprising an integral body of resilient material having a generally flat end stop, an upwardly projecting semicircular hook portion subtending an arc somewhat greater than 180° and adapted to snap over said rail means, a button means on said end stop below the said hook portion adapted to prevent dislodgement of the said hook portion when engaged with said rail means, and a generally elongated cruciform structure projecting normally from said end stop on a side of the stop disposed away from the said hook portion, such cruciform structure having lateral supports and defining a cross-section adapted to fit smoothly within said outer rod means;

retaining means to retain said cruciform structure of said rail engaging means within said outer rod means;

spring attachment means on said cruciform structure of said rail engaging means whereby said spring means may be attached to said cruciform structure and secured within said outer rod means for ease of assembly.

2. Support rod apparatus as claimed in claim 1 including extension rod means adapted to be slideably received within said outer rod means, for extending the length of said inner rod means.

3. Support rod apparatus for use in association with two structures such as a wall, and rail means spaced from such wall, for removably locating a support rod extending between said structures, said apparatus comprising;

outer tubular rod means shorter than the spacing between said structures;

inner rod means telescopically receivable within said outer rod means, and being shorter than the spacing between said structures;

spring means located within said outer rod means, and engageable with said inner rod means for normally biasing the same outwardly of said outer rod means;

wall engaging means on the free end of one said rod means, for engaging said wall;

rail engaging means on the free end of the other said rod means, comprising an integral body of resilient material having a generally flat end stop, an upwardly projecting semicircular hood portion subtending an arc somewhat greater than 180° and adapted to snap over said rail means, a button means on said end stop below the said hook portion adapted to prevent dislodgement of the said hook portion when engaged with said rail means, and a generally elongated cruciform structure projecting normally from said end stop on a side of the stop disposed away from the said hook portion, such cruciform structure having lateral supports and defining a cross-section adapted to fit smoothly within said other rod means, and retaining means to retain said cruciform structure of said rail engaging means within said other rod means.

4. Support rod apparatus as claimed in claim 3 including extension rod means adapted to be slideably received within said outer rod means, for extending the length of said inner rod means.

* * * * *